US008857976B2

(12) United States Patent
Nakada et al.

(10) Patent No.: US 8,857,976 B2
(45) Date of Patent: Oct. 14, 2014

(54) IMAGE FORMING APPARATUS

(71) Applicants: Kikuya Nakada, Saitama (JP); Masato Ogawa, Kanagawa (JP); Takashi Hatano, Saitama (JP)

(72) Inventors: Kikuya Nakada, Saitama (JP); Masato Ogawa, Kanagawa (JP); Takashi Hatano, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 13/773,733

(22) Filed: Feb. 22, 2013

(65) Prior Publication Data

US 2013/0222457 A1 Aug. 29, 2013

(30) Foreign Application Priority Data

Feb. 25, 2012 (JP) ..... 2012-039446
Feb. 25, 2012 (JP) ..... 2012-039448

(51) Int. Cl.
*B41J 2/01* (2006.01)
*B41J 11/00* (2006.01)
*B41J 15/02* (2006.01)

(52) U.S. Cl.
CPC ..... *B41J 11/0095* (2013.01); *B41J 11/0075* (2013.01); *B41J 15/02* (2013.01)
USPC ..... 347/104

(58) Field of Classification Search
USPC ..... 347/16, 101, 102, 104, 105, 108
See application file for complete search history.

(56) References Cited

U.S. PATENT DOCUMENTS

| | | | | |
|---|---|---|---|---|
| 7,575,316 | B2 * | 8/2009 | Silverbrook et al. | 347/104 |
| 2004/0155141 | A1 | 8/2004 | Tokunaga | |
| 2010/0245514 | A1 * | 9/2010 | Kaimoto et al. | 347/104 |
| 2011/0063644 | A1 | 3/2011 | Niihara et al. | |
| 2011/0064497 | A1 | 3/2011 | Niihara et al. | |
| 2011/0211210 | A1 | 9/2011 | Niihara et al. | |
| 2011/0229242 | A1 | 9/2011 | Morinaga et al. | |
| 2012/0032021 | A1 | 2/2012 | Morinaga et al. | |

FOREIGN PATENT DOCUMENTS

| | | |
|---|---|---|
| JP | 2001-121765 | 5/2001 |
| JP | 2004-142171 | 5/2004 |
| JP | 2009-269713 | 11/2009 |

* cited by examiner

*Primary Examiner* — Kristal Feggins
(74) *Attorney, Agent, or Firm* — Cooper & Dunham LLP

(57) ABSTRACT

An image forming apparatus includes a medium that is a long roll wound around a core member; a feeding unit configured to feed the medium; an image forming unit configured to form an image on the medium; a fixed roll end detecting unit configured to detect an end of the medium whose end is fixed to the core member; a determining unit configured to determine whether to stop, for a time period, the medium on which the image has been formed by the image forming unit, when the fixed roll end detecting unit detects the end of the medium; and a control unit configured to stop an operation of the feeding unit when the determining unit determines to stop the medium for the time period, and to cause the feeding unit to perform an operation of winding back the medium when the time period has elapsed.

9 Claims, 10 Drawing Sheets

IMAGE FORMING APPARATUS

BACKGROUND OF THE INVENTION

1. Field of the Invention

The present invention relates to image forming apparatuses, and more particularly to an image forming apparatus using a roll type medium.

2. Description of the Related Art

As a printer, a fax machine, a copier, a plotter, or an image forming apparatus that is a multifunction peripheral, there is known an inkjet recording device that is an image forming apparatus of a liquid jetting recording method using a recording head including liquid jetting heads (liquid droplet jetting heads) for jetting liquid droplets.

Among such image forming apparatuses, there is an image forming apparatus that uses, as a recording medium for forming images, roll paper that is a roll type medium in which a long medium is wound around a core member (tube) as a roll.

Conventionally, there is known a technology of determining whether it is a state where the end of the roll paper is fixed to the core member and the roll paper cannot be conveyed, and when the end of the roll paper is detected, the roll paper is wound back or the roll paper is cut and then wound back (see Patent Document 1).

However, when the end of the roll paper is fixed to the core member, and the roll paper is immediately cut or wound back after detecting the end of the roll paper, ink adheres to the conveying roller for conveying the roll paper and to the tip of the cutter.

In another conventional technology, when the end of a continuous paper sheet is detected with a real end sensor after a paper end sensor detects the end of a continuous sheet and before the printing ends, printing on the continuous paper sheet is stopped, and the continuous paper sheet is ejected from an ejection outlet (see Patent Document 2).

However, when a paper end sensor and a real end sensor are provided, and printing is stopped when the real end sensor detects the end of the roll paper, but the remaining print information that is not printed can be recorded in the area of the roll paper between the real end sensor and the recording head, the roll paper is wasted.

Patent Document 1: Japanese Laid-Open Patent Publication No, 2009-269713

Patent Document 2: Japanese Laid-Open Patent Publication No. 2001-121765

SUMMARY OF THE INVENTION

The present invention provides an image forming apparatus, in which one or more of the above-described disadvantages are eliminated.

A preferred embodiment of the present invention provides an image forming apparatus in which when a roll type medium has its end fixed and the end is detected and the roll type medium is wound back, ink does not adhere to the conveying roller or the cutting means.

A preferred embodiment of the present invention provides an image forming apparatus in which even after the end of the roll type medium is detected, the image forming operation is continued, so that wasteful consumption of the roll type medium is reduced.

According to an aspect of the present invention, there is provided an image forming apparatus including a roll type medium including a long medium that is wound around a core member as a roll; a feeding unit configured to feed the roll type medium; an image forming unit configured to form an image on the roll type medium; a fixed roll end detecting unit configured to detect an end of the roll type medium whose end is fixed to the core member; a determining unit configured to determine whether to stop, for a predetermined time period, the roll type medium on which the image has been formed by the image forming unit, when the fixed roll end detecting unit detects the end of the roll type medium; and a control unit configured to stop an operation of the feeding unit when the determining unit determines to stop the roll type medium for the predetermined time period, and to cause the feeding unit to perform an operation of winding back the roll type medium when the predetermined time period has elapsed.

BRIEF DESCRIPTION OF THE DRAWINGS

Other objects, features and advantages of the present invention will become more apparent from the following detailed description when read in conjunction with the accompanying drawings, in which:

FIG. 1 is a schematic side view of the image forming apparatus;

DETAILED DESCRIPTION OF THE PREFERRED EMBODIMENTS

Figure 1:
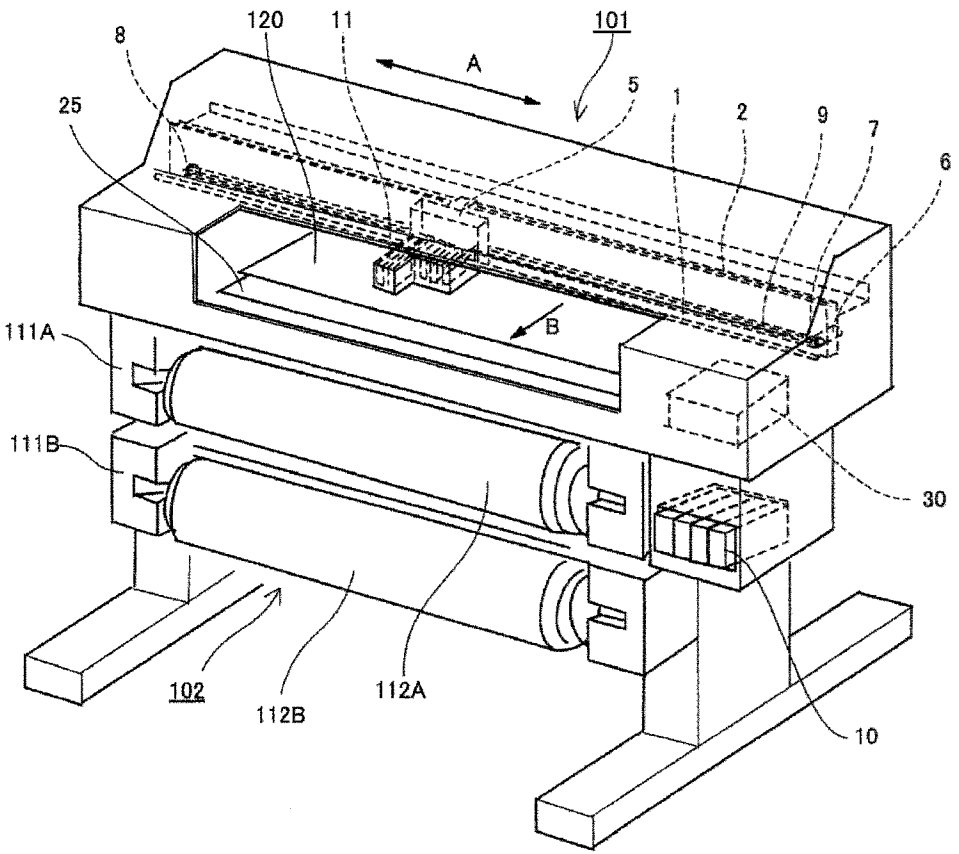
FIG. 1 is an external perspective view of an image forming apparatus according to an embodiment of the present invention.
Figure 2:
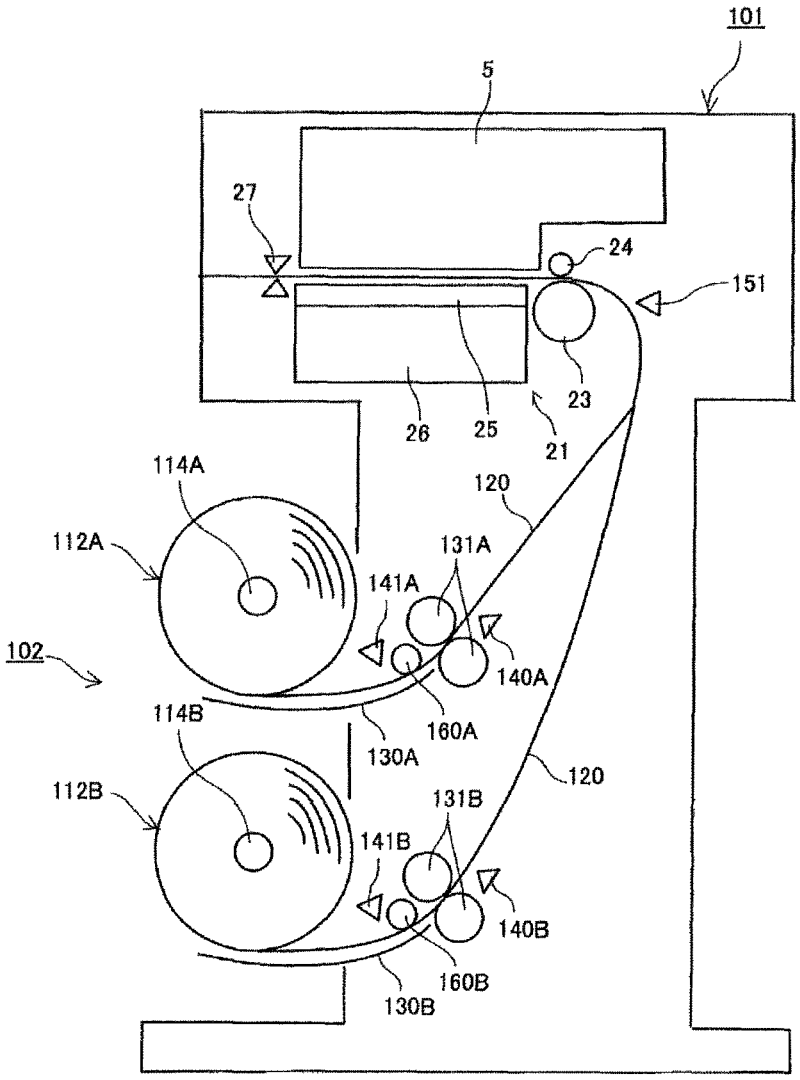
Figure 3:
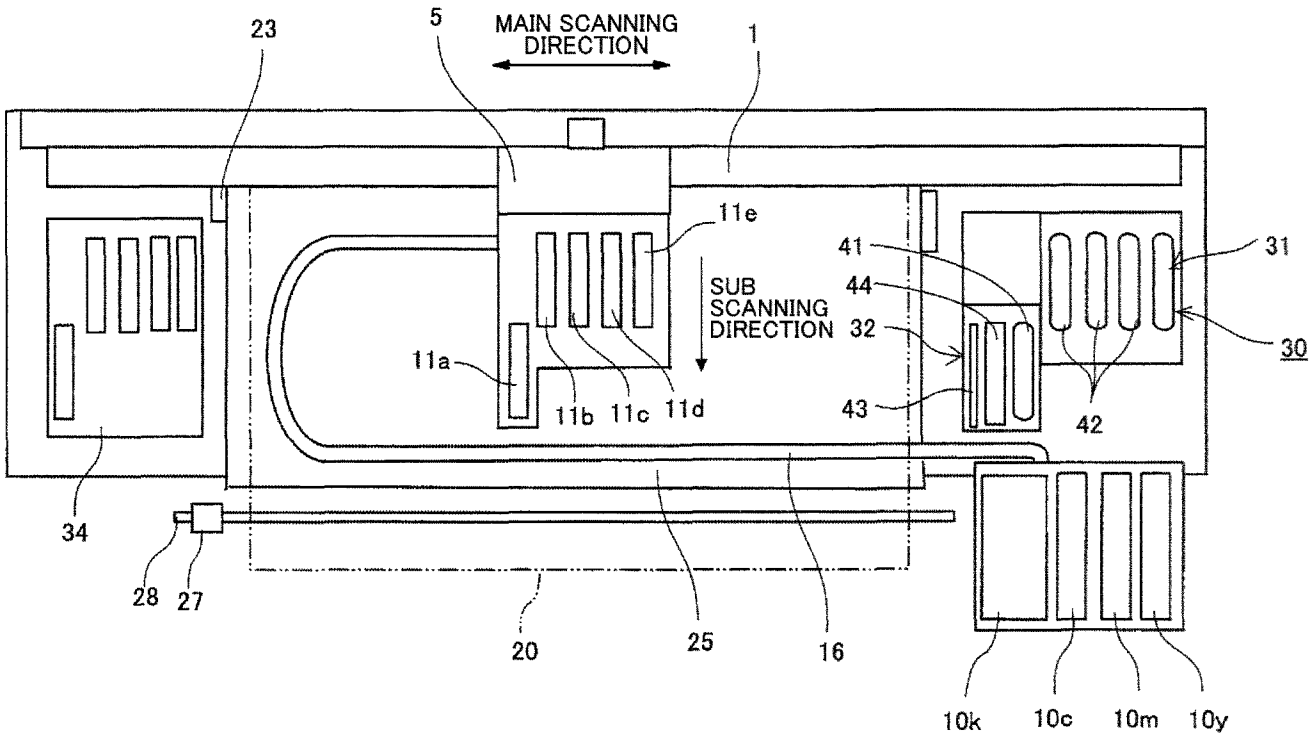
FIG. 3 is a plan view of relevant parts of the mechanism part of the image forming apparatus.

A description is given, with reference to the accompanying drawings, of embodiments of the present invention. A description is given of an image forming apparatus according to one embodiment with reference to FIGS. 1 through 3. FIG. 1 is an external perspective view of the image forming apparatus, FIG. 2 is a schematic side view of the image forming apparatus, and FIG. 3 is a plan view of relevant parts of the mechanism part of the image forming apparatus.

The image forming apparatus is a serial type image forming apparatus, including a device main body 101 and a sheet feeding device 102 located below the device main body 101.

Inside the device main body 101, a guide rod 1 and a guide stay 2 which are guide members are bridged between plates on both sides (not shown), and a carriage 5 is held by the guide rod 1 and the guide stay 2 so as to be movable in a direction indicated by an arrow A (main scanning direction, carriage movement direction).

A main scanning mechanism part that moves the carriage 5 includes a main scanning motor 6 located on one side of the main scanning direction; a driving pulley 7 rotated by the main scanning motor 6; a subordinate pulley 8 located on the other side of the main scanning direction; and a timing belt 9 that is a towing member wound around the driving pulley 7 and the subordinate pulley 8.

As shown in FIG. 3, the carriage 5 includes recording heads 11*a* through 11*e* (referred to as "recording head 11" when not distinguished) in which plural (five in this example) liquid jetting heads for jetting liquid droplets of the respective colors of black (K), yellow (Y), magenta (M), and cyan (C) and head tanks for supplying liquid to the heads are integrally combined. These recording heads 11*a* through 11*e* are arranged as nozzle rows including plural nozzles in a sub scanning direction orthogonal to the main scanning direction, and are fixed so that the droplet jetting direction is downward.

The position of the recording head Ila is shifted with respect to the recording heads 11*b* through 11*e* by a length of one head (one nozzle row) in the sub scanning direction orthogonal to the main scanning direction. Each of the recording heads 11*a* through 11*e* has two nozzle rows. The recording head 11*a* and 11*b* jets liquid droplets of the same color which is black, and the recording heads 11*c* through 11*e* jet liquid droplets of magenta (M), cyan (C), and yellow (Y), respectively.

Accordingly, when forming monochrome images, the recording heads 11*a* and 11*b* are used, so that the image can be formed by a width corresponding to two heads by one scan (main scanning). When forming color images, the recording heads 11*c* through 11*e* are used.

To the head tank of the recording head 11, ink of the respective colors is supplied via a supply tube 15 from ink cartridges 10*k*, 10*c*, 10*m*, and by which are replaceable main tanks attached to the device main body 101. In this case, ink is supplied to the two recording heads 11*a* and 11*b* that jet liquid droplets of the same color from one ink cartridge 10*k*.

Meanwhile, among the main scanning areas of the carriage 5, in the recording area, a roll paper sheet 120 is fed from the sheet feeding device 102. The roll paper sheet 120 is intermittently conveyed, by a conveying unit 21, in a direction (sub scanning direction, sheet conveying direction: direction indicated by an arrow B) orthogonal to the sub scanning direction of the carriage.

The conveying unit 21 includes a conveying roller 23 for conveying the roll paper sheet 120 that is a roll type medium fed from the sheet feeding device 102, a pressurizing roller 24 facing the conveying roller 23, a conveying guide member 25 in which plural suction holes are formed, and a suction fan 26 acting as a suction means for performing suction through the suction holes of the conveying guide member 25.

On the downstream side of the conveying unit 21, as shown in FIG. 2, there is provided a cutter 27 acting as a cutting means for cutting the roll paper sheet 120 on which an image has been formed by the recording head 11 by a predetermined length.

This cutter 27 is attached to a wire or a timing belt 28. The timing belt 28 is wound around a driving pulley driven by a driving motor (not shown) and a subordinate pulley. By moving the timing belt 28 in a main scanning direction A by the driving motor via the driving pulley, the sheet is cut by a predetermined length by the cutter 27.

Furthermore, on one side of the main scanning direction of the carriage 5 and beside the conveying guide member 25, a maintenance recovery mechanism 30 is provided. The maintenance recovery mechanism 30 is for performing maintenance/recovery on the recording head 11. On the other side of the main scanning direction of the carriage 5 and beside the conveying guide member 25, an idle jetting receiver 34 is provided. The idle jetting receiver 34 is for performing idle jetting to jet liquid droplets that do not contribute to image formation from the recording head 11.

The maintenance recovery mechanism 30 includes a first maintenance recovery unit 31 held by a frame member of the device main body 101, and a second maintenance recovery unit 32 held by a frame member of the maintenance recovery mechanism 30 so as to be movable in a reciprocating manner in the sub scanning direction. The second maintenance recovery unit 32 is at the position of FIG. 3 when performing maintenance/recovery on the recording head 11*a*, and moves to the same position as the first maintenance recovery unit 31 in the sub scanning direction when performing maintenance/recovery on the recording heads 11*b* through 11*e*.

The maintenance recovery mechanism 30 includes a suction cap 41 and moisturizing caps 42 serving as moisturizing caps for capping the nozzle surfaces (surface on which nozzle is formed) of the recording heads 11, a wiper member 43 for wiping the nozzle surfaces, and an idle jetting receiver 44 for receiving liquid droplets (idle jetting droplets) that do not contribute to image formation.

The sheet feeding device 102 includes spool shaft receiving stands 111A and 111B which are at a top stage and a bottom stage (hereinafter, referred to as "spool shaft receiving stand 111" when not distinguished; the same applies to other members; reference numerals of members of the top stage are accompanied by a letter "A" while reference numerals of members of the bottom stage are accompanied by a letter "B" to distinguish between the top and bottom stages). Inside the spool shaft receiving stand 111, there is provided a roll out mechanism for rolling out the roll paper sheet 120 from a roll body 112 and winding back the roll paper sheet 120.

The roll body 112 has a sheet (hereinafter, "roll paper sheet") that is a long roll type medium wound as a roll around a tube 114 that is a core member. The roll body collectively refers to a member combining the tube 114 and the roll paper sheet 120.

Here, in the present embodiment, the roll body 112 may be formed by fixing the end of the roll paper sheet 120 to the tube 114 by adhering the end with paste (hereinafter, "adhering roll"), or may be a non-fixed type in which the end of the roll paper sheet 120 is not fixed to the tube 114 by adhering the end with paste (hereinafter, "non-adhering roll").

By rotating the roll body 112 attached to the spool shaft receiving stand 111, the roll paper sheet 120 is sent out to the downstream side along a guide member 130.

In the downstream side in the sending out direction of the spool shaft receiving stand 111, a pair of conveying rollers 131 are located for causing the roll paper sheet 120 sent out from the roll body 112 to curve and move in the upward direction. Between the conveying rollers 131 and the spool shaft receiving stand 111, a subordinate roller 160 is located, which is rotated by the movement of the roll paper sheet 120 by being in contact with the top surface of the roll paper sheet 120. Between the spool shaft receiving stand 111 and the conveying rollers 131, the guide member 130 is located, which is for guiding the bottom surface of the roll paper sheet 120.

By rotating the conveying rollers 131, the roll paper sheet 120 rolled out from the roll body 112 is conveyed by being stretched among the conveying rollers 131, the subordinate roller 160, and the roll body 112. Then, the roll paper sheet 120 passes through the conveying rollers 131 and enters in between the conveying roller 23 and the pressurizing roller 24 of the conveying unit 21.

In an image forming apparatus having the above configuration, the carriage 5 is moved in the main scanning direction, and the roll paper sheet 120 fed from the sheet feeding device 102 is intermittently conveyed by the conveying unit 21, while liquid droplets are jet by driving the recording head 11 according to image information (printing information), to form the desired image on the roll paper sheet 120. The roll paper sheet 120 on which the image is formed is cut to a predetermined length by the cutter 27, and then ejected to a sheet eject tray (not shown) located at the front side of the device main body 101.

In the image forming apparatus, in order to detect the end of the roll paper sheet 120, the following detecting units are provided. Specifically, a non-adhering roll end detecting unit 140 for detecting the end of a non-adhering roll is provided at the downstream side of the pair of conveying rollers 131 in the roll sheet conveying direction (sheet feeding direction). Furthermore, an adhering roll end detecting unit 141, which is an end detecting means according to an embodiment of the present invention for detecting the end of an adhering roll, is provided on the upstream side of the subordinate roller 160 in the roll paper conveying direction.

The non-adhering roll end detecting unit 140 is constituted by, for example, an optical sensor, and detects the end of the roll paper sheet 120 according to changes in the amount of light when the end of the roll paper sheet 120 passes through.

Figure 4:
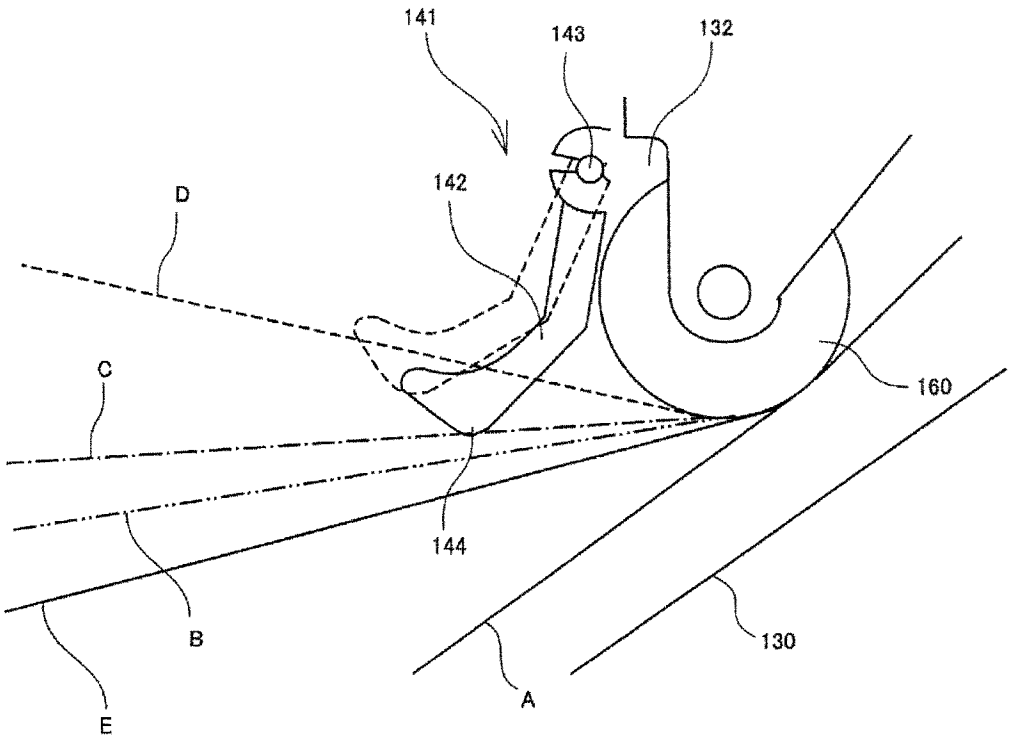
FIG. 4 is an enlarged side view of relevant parts for describing an adhering roll end detecting unit.

Next, a description is given of the adhering roll end detecting unit 141 with reference to FIG. 4. FIG. 4 is an enlarged side view of relevant parts for describing the adhering roll end detecting unit 141.

The adhering roll end detecting unit 141 includes a lever member 142, which is located on the upstream side in the roll paper conveying direction of the subordinate roller 160, which is a member that is at the most upstream side in the conveying direction, and a member with which the top surface of the roll paper sheet 120 sent out from the roll body 112 first comes in contact. The lever member 142 is a displacing member that is rotated/moved by contacting the roll paper sheet 120, as the roll paper sheet 120 is stretched between the subordinate roller 160 and the tube 114 that is a core member.

The lever member 142 includes a rotation shaft (rotation center) 143 that is rotatably held by a supporting part 132 for supporting the subordinate roller 160. The lever member 142 also includes a detection part 144 which contacts the roll paper sheet 120 and which is located on the upstream side of the rotation shaft 143 in the roll sheet conveying direction.

Furthermore, although not shown, there is a means for detecting that the lever member 142 has rotated by more than a predetermined amount (a switch or an optical sensor). When the lever member 142 has rotated by more than a predetermined amount, it is detected that the end of the roll paper sheet 120 has come (roll end).

A description is given of an operation of detecting the end of the roll paper sheet 120 that is an adhering roll, performed by the adhering roll end detecting unit 141.

First, in regular circumstances, the roll paper sheet 120 is fed/guided at the position of a line A in FIG. 4, by the outer periphery of the roll body 112, the pair of conveying rollers 131, and the subordinate roller 160. Therefore, the detection part 144 of the lever member 142 does not contact the roll paper sheet 120.

As the end of the roll paper sheet 120 approaches, the position of the roll paper sheet 120 between the outer periphery of the roll body 112 and the subordinate roller 160 rises. When the roll paper sheet 120 comes to the end, the roll paper sheet 120 is stretched between the subordinate roller 160 and the tube 114, and the pasted position (adhering position) rises above the subordinate roller 160, and therefore the position of the roll paper sheet 120 reaches the end line D.

At this time, the lever member 142 is rotated upward during the time from when the roll paper sheet 120 contacts the detection part 144 of the lever member 142 and the roll paper sheet 120 reaches the end line D. Thus, it is detected that the roll paper sheet 120 has come to an end (roll end) when the lever member 142 is rotated upward from the position where the lever member 142 is illustrated by a solid line to a position where the lever member 142 is illustrated by a dashed line in FIG. 4. The position where the lever member 142 is illustrated by the dashed line (roll end detection position) is at the intermediate position between the end line D of the roll paper sheet 120 and a line C which is described below.

Figure 5:
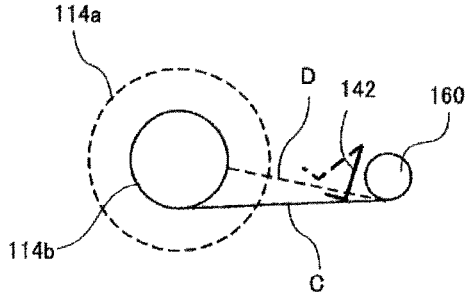
FIG. 5 is a schematic side view for describing the position of a lever member of the adhering roll end detecting unit.

Next, a description is given of the position of the lever member 142 of the adhering roll end detecting unit 141 with reference also to FIG. 5. FIG. 5 is a schematic side view for describing the position of the lever member 142 of the adhering roll end detecting unit 141.

In the present embodiment, either a 3-inch adhering roll 112*a* or a 2-inch non-adhering roll 112*b* may be attached as the roll paper sheet 120. The 2-inch non-adhering roll 112*b* is the roll body 112 having the smallest radius used in the present apparatus.

The position of the center of a tube 114*a* of the 3-inch adhering roll 112*a* and the position of the center of a tube 114*b* of the 2-inch non-adhering roll 112*b* are the same. Furthermore, the center of the tube 114 is positioned above the lower end of the outer periphery of the subordinate roller 160. Furthermore, the end line D is substantially the same in both cases of the 3-inch adhering roll 112*a* and the 2-inch non-adhering roll 112*b*.

In FIG. 4, the line A indicates the position of the 3-inch adhering roll 112*a* in a regular state (a state when the roll paper sheet 120 is fed for image formation). A line B indicates the position of the roll paper sheet 120 that is a non-adhering roll that has separated from the tube 114. A line 11 indicates the position of the 2-inch non-adhering roll 112*b* in a regular state.

When the end of the roll paper sheet 120 separates from the tube 114*b* of the 2-inch non-adhering roll 112*b* whose end is not adhered, the end flaps and moves upward, and may push the tube 114 of the lever member 142 upward. When the lever member 142 is pushed upward, as described above, an erroneous detection may be made that the end of the roll paper sheet 120 of the 2-inch non-adhering roll 112*b* or the 3-inch adhering roll 112*a* has approached.

Thus, the position where the end of the roll paper sheet 120 separates from the tube 114*b* of the 2-inch non-adhering roll 112*b* is set as the position of line C. This line C connects the bottom edge of the tube 114 of the 2-inch non-adhering roll 112*b* around which the roll paper sheet 120, having the smallest radius that can be used in this image forming apparatus, is wound, and the contact position of the subordinate roller 160.

The lever member 142 is disposed such that the detection part 144 of the lever member 142 is positioned between the end line D of the tube 114 of the 3-inch adhering roll 112*a* and the line C.

That is to say, in the present embodiment, when the roll paper sheet having the smallest radius that can be used is the 2-inch non-adhering roll, and the lever member 142 is rotated above the line C connecting the bottommost edge of the tube 114*b* of the 2-inch non-adhering roll 112*b* and the contact position of the subordinate roller 160, it is detected that the end of the roll paper sheet 120 of the 3-inch adhering roll 112*a* has approached.

Accordingly, it is possible to prevent an erroneous detection caused when the end of the non-adhering roll flaps, and the end of the roll paper sheet of an adhering roll can be reliably detected.

Furthermore, depending on the type of roll body, there may be a format in which the end is tentatively adhered to the tube. In this case, the end moves above the line C in FIG. 5. The end rises while being stretched between the subordinate roller 160 and the tube, and therefore while the end is rising, the tentative adhering state is released and the end moves toward the subordinate roller 160. At this time, the extent to which the end flaps upward is larger than that of a non-adhering state.

Therefore, in order to prevent an erroneous detection of detecting an end of an adhering roll even though the roll body has an end that is tentatively adhered, the end of an adhering roll is preferably detected when the lever member 142 is pushed upward from the intermediate position between the end line D of the tube 114*a* of the 3-inch adhering roll 112*a* and the line C. Accordingly, it is not recognized that an end of an adhering roll has approached, and therefore the recording operation can be continued.

Furthermore, in the above embodiment, the subordinate roller 160 is disposed between the roll body 112 and the pair of conveying rollers 131, and it is detected that the roll paper sheet 120 has been stretched between the subordinate roller 160 and the tube 114. However, when there is no subordinate roller 160, and there is only the pair of conveying rollers 131, it is to be detected that the roll paper sheet 120 is stretched between the top roller of the pair of conveying rollers 131 and the tube 114. Alternatively, when a guide member that contacts the roll paper sheet 120 is disposed instead of the subordinate roller 160, it is to be detected that the roll paper sheet 120 is stretched between this guide member and the tube 114.

Figure 6:
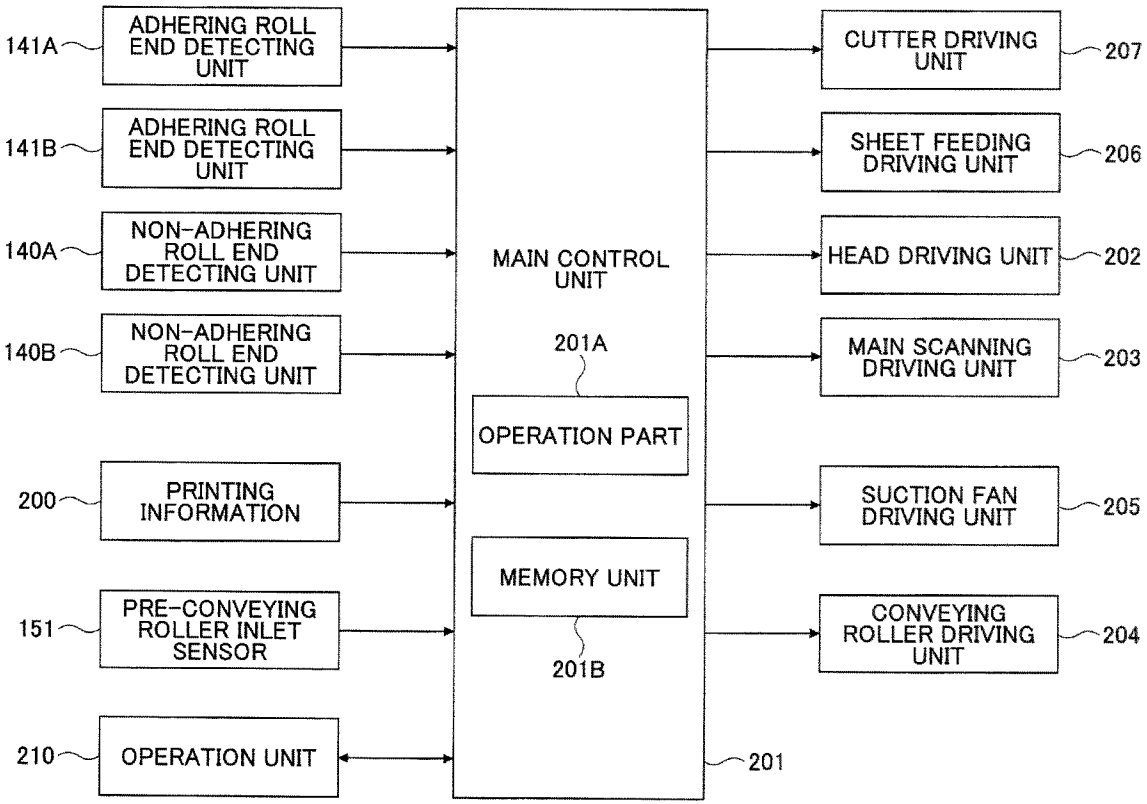
FIG. 6 is a schematic block diagram of a control unit of the image forming apparatus.

Next, a description is given of the control operation after detecting the end of a roll paper sheet with reference to FIG. 6 and onward. First, a description is given of the overview of a control unit of this image forming apparatus with reference to the block diagram of FIG. 6.

A main control unit 201 is constituted by a CPU, a ROM, a RAM, and a microcomputer such as I/O. The main control unit 201 includes an operation part 201A constituted by a CPU and a memory unit 201B constituted by a ROM and a RAM. As described below, the main control unit 201 acts as a control unit for controlling the operation of winding back the roll paper sheet 120 after detecting roll end, and controlling continuation of the image forming operation on the remaining parts of the roll paper sheet 120 after detecting roll end.

The main control unit 201 inputs printing information 200 provided from the host side. In order to form an image according to the printing information 200, by driving a rolling out mechanism inside the spool shaft receiving stand 111 and the pair of conveying rollers 131 via a sheet feeding driving unit 206, the roll paper sheet 120 is fed out (fed and conveyed) from the roll body 112 in the top stage or the bottom stage of the sheet feeding device 102.

Furthermore, the main control unit 201 moves the carriage 5 in the main scanning direction by driving/controlling the main scanning motor 6 via a main scanning driving unit 203, rotates/drives the conveying roller 23 via a conveying roller driving unit 204, and drives the suction fan 26 via a suction fan driving unit 205, and moves the roll paper sheet 120 in the sub scanning direction, and drives/controls the recording head 11 via a head driving unit 202 according to the printing information 200, causes the recording head 11 to jet a necessary amount of liquid droplets, and forms a desired image on the roll paper sheet 120.

Furthermore, the main control unit 201 drives the cutter 27 via a cutter driving unit 207, and causes the cutter 27 to cut the roll paper sheet 120 on which image formation has been completed to a desired length.

To the main control unit 201, an end detection signal from the adhering roll end detecting unit (sensor) 141 that is the above described fixed roll end detection unit, and an end detection signal from the non-adhering roll end detecting unit (sensor) 140 that is the above described non-fixed roll end detection unit, are input.

In the main control unit 201, detection signals are input from a pre-conveying roller inlet sensor 151 that is a medium detecting unit for detecting the roll paper sheet 120 before the nip part (inlet) of the conveying roller 23 and the pressurizing roller 24 shown in FIG. 2. The pre-conveying roller inlet sensor 151 is to be located between the image forming area of the recording head 11 and the pair of conveying rollers 131.

Furthermore, an operation unit 210 is connected to the main control unit 201. From this operation unit 210, the type of roll paper sheet 120 may be input, but the type of roll paper sheet 120 to be used may also be input from a host side connected to this image forming apparatus.

Figure 7:
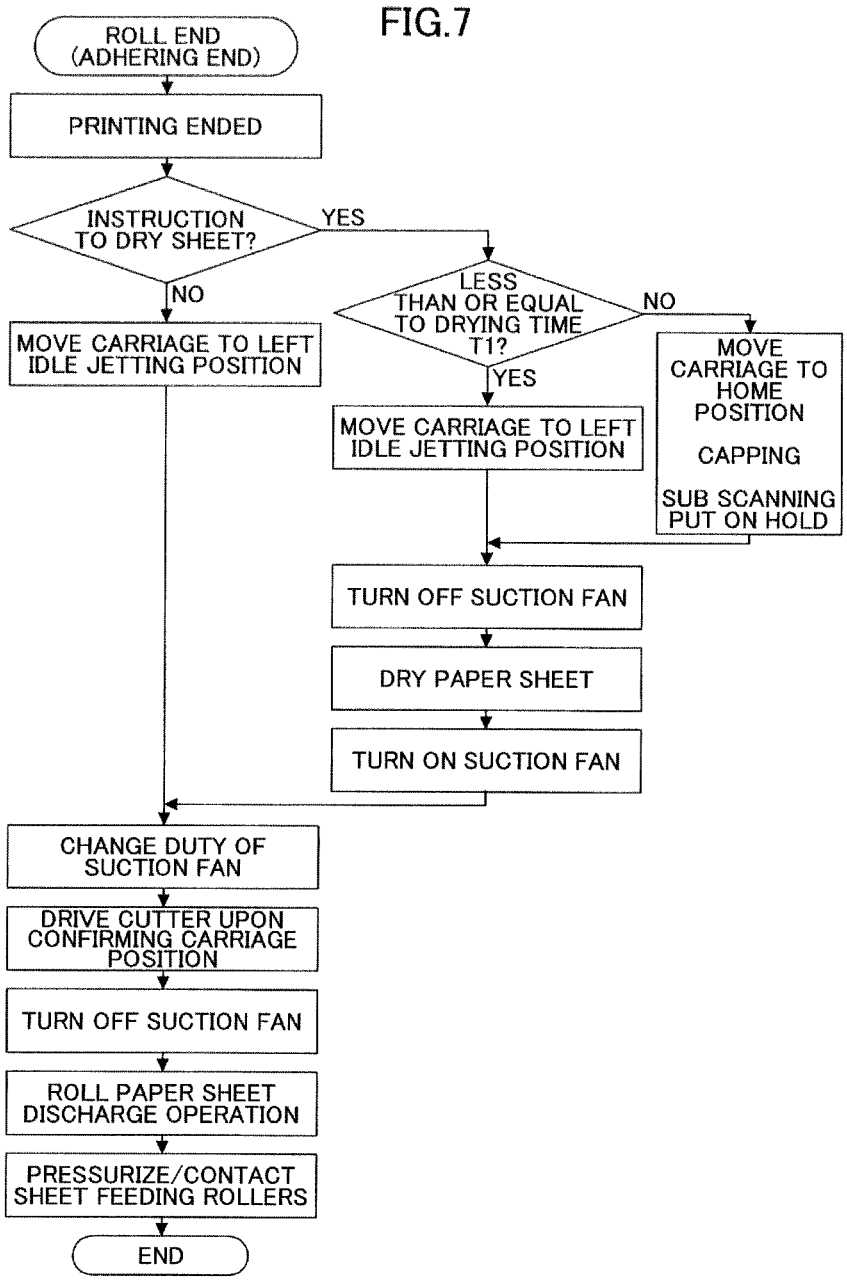
FIG. 7 is a flowchart of an operation after detecting the end of an adhering roll.

Next, a description is given of an operation after detecting the end of the adhering roll performed by this control unit with reference to the flowchart of FIG. 7.

First, when roll end is detected by the adhering roll end detecting unit 141, it is determined whether an instruction to dry the roll paper sheet 120 is given.

It is determined whether an instruction to dry the roll paper sheet 120 is given by, for example, inputting the type of roll paper sheet to be used, and referring to a table stored in the memory unit 2016 of the main control unit 201 indicating the association of the type of roll paper sheet, whether drying is necessary, and the drying time. This instruction for drying is also an instruction for stopping the roll paper sheet 120 on which an image has been formed by the image forming unit for a predetermined time length.

When an instruction to dry the roll paper sheet is given, it is determined whether the drying time (stopping time, waiting time) of the roll paper sheet is less than or equal to a time T1.

When the drying time is less than or equal to a time T1, the carriage 5 is moved to the position of the idle jetting receiver 34 which is the left idle jetting receiver. Furthermore, when the drying time is not less than or equal to a time T1, the carriage 5 is moved to a home position (position on the side of the maintenance recovery mechanism 30), and the nozzle surfaces of the recording heads 11 are capped with the suction cap 41 and the moisturizing caps 42, and sub scanning is put on hold.

In either case, the driving of the suction fan 26 is stopped (OFF), the driving of the pair of conveying rollers 131 is stopped, and then the sending of the roll paper sheet 120 is stopped during the drying time to dry the sheet.

When the drying time has elapsed, the suction fan 26 is driven (ON), the driving duty of the suction fan 26 is changed, the position of the carriage 5 is confirmed, and then the cutter 27 is driven to cut the roll paper sheet 120. That is to say, when cutting with the cutter 27, the suction fan 26 is driven to suction the suction fan 26 onto the conveying guide member 25, so that the cutting of the roll paper sheet 120 can be easily and accurately performed.

Then, the driving of the suction fan 26 is stopped, and the above-described roll out mechanism is driven/controlled via the sheet feeding driving unit 206 to perform the operation of winding back the roll paper sheet 120 to the tube 114 (roll paper sheet discharge operation), and the pair of conveying rollers 131 (sheet feeding rollers) are caused to pressurize/contact each other.

When there is no instruction for drying the sheet, the carriage 5 is moved to the position of the idle jetting receiver 34 which is the left idle jetting receiver, the driving duty of the suction fan 26 is changed, the position of the carriage 5 is confirmed, and then the cutter 27 is driven to cut the roll paper sheet 120.

Then, the driving of the suction fan 26 is stopped, the operation of winding back the roll paper sheet 120 (roll paper sheet discharge operation) is performed, and the pair of conveying rollers 131 (sheet feeding rollers) are caused to pressurize/contact the roll paper sheet 120.

Here, in the roll paper sheet discharge operation, for example, the roll out mechanism for driving a spool shaft 119A is driven/controlled in the winding back direction, and the conveying roller 23 is also reverse rotated, to wind back the roll paper sheet 120. At this time, after the front end of the roll paper sheet 120 passes through the sensor 190A, and when a predetermined time period has elapsed, the operation of winding back the roll paper sheet is completed.

Then, after the operation of winding back the roll paper sheet is completed, in order to be in a state of waiting for the replacement of the roll paper sheet 120 to be inserted, the pair of conveying rollers 131 (sheet feeding rollers) are pressurized with each other (pressurize/contact sheet feeding rollers). The rollers are caused to pressurize/contact each other because although not shown in the figures, the pair of conveying rollers 131 is separated from each other in the previous stage.

As described above, when the end of an adhering roll is detected, the roll paper sheet is stopped for a predetermined time period and drying is performed, and subsequently the roll paper sheet is cut and wound back. Therefore, it is possible to prevent ink, which is not dried on the side of the sheet on which an image is formed, from adhering to and soiling the conveying roller and the cutter.

Figure 8:
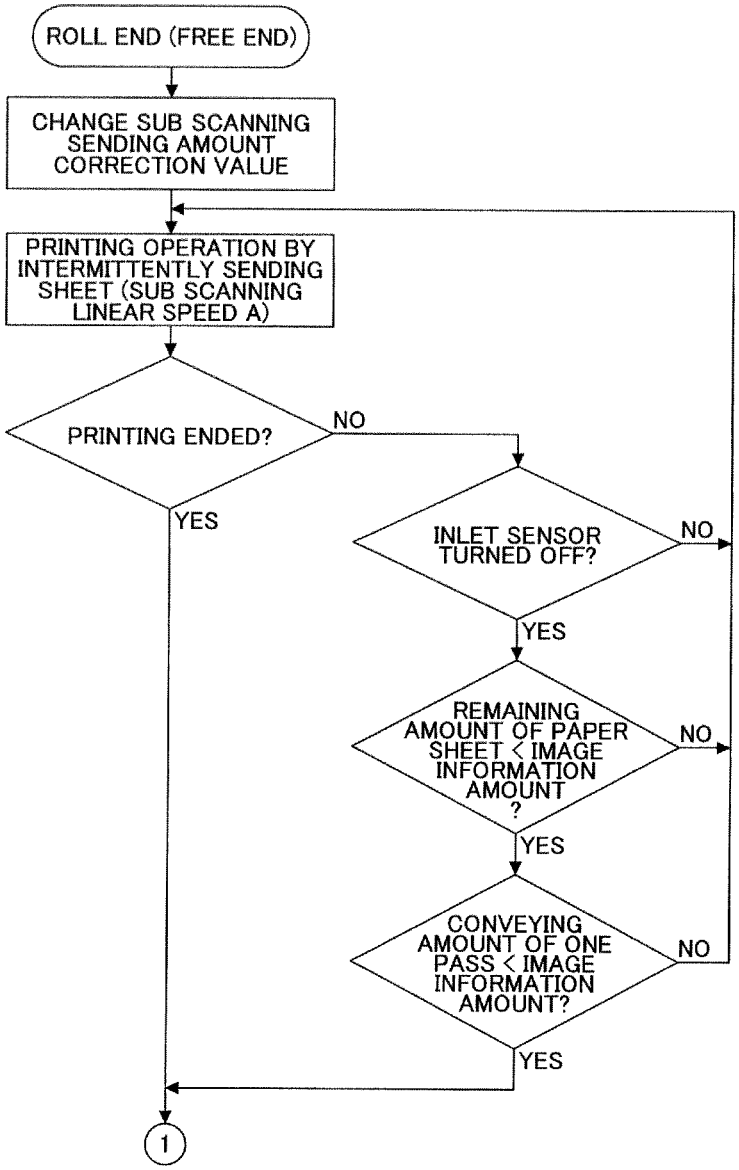
FIG. 8 is a flowchart of an operation after detecting the end of a non-adhering roll.
Figure 9:
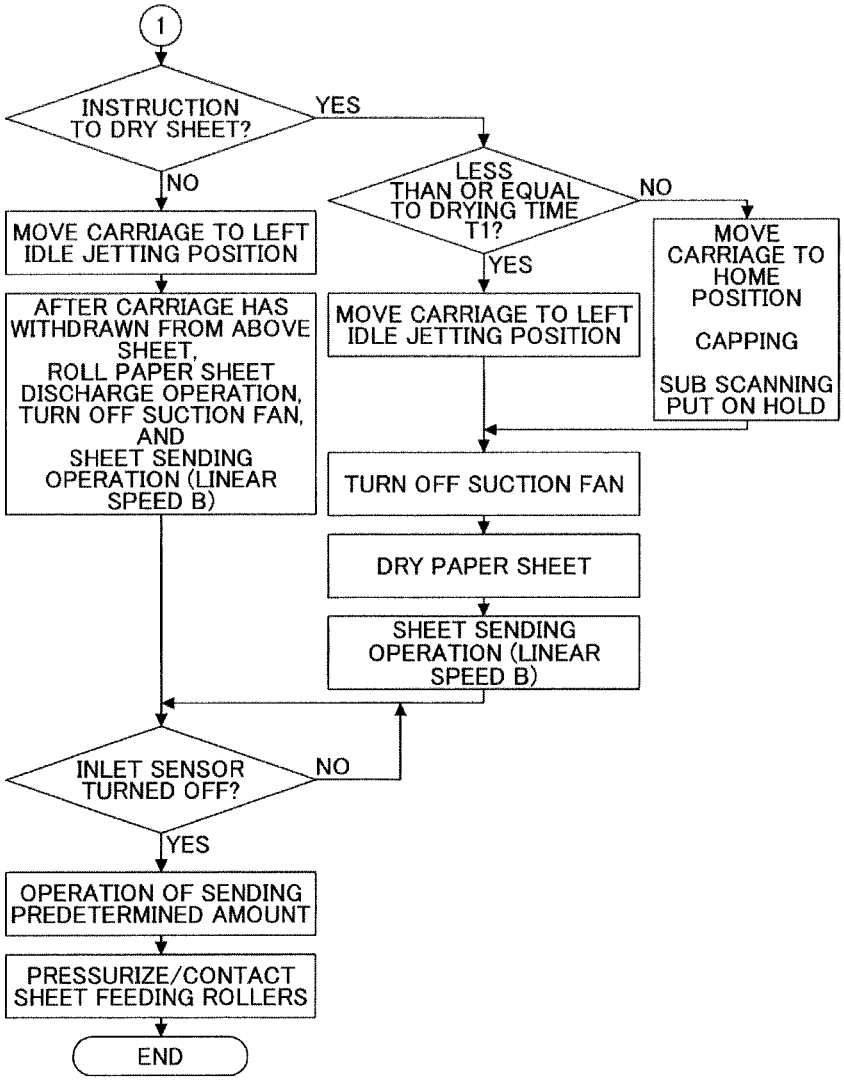
FIG. 9 is a flowchart continued from FIG. 8.

Next, a description is given of an operation after detecting the end of a non-adhering roll with reference to the flowcharts of FIGS. 8 and 9.

With the non-adhering roll, the end of the roll paper sheet 120 can be conveyed up to the image forming area of the roll paper sheet 120, and therefore images are formed in the area extending from the image forming area to the end of the roll paper sheet 120.

That is to say, with reference to FIG. 8, when the non-adhering roll end detecting unit 140 detects roll end, a sub scanning sending amount correction value is changed. When printing from when roll end is detected to when the end of the roll paper sheet 120 passes the image forming area, the sub scanning sending amount is made to be smaller than the regular sending amount. Accordingly, it is possible to form images in a stable manner.

Then, the roll paper sheet 120 is intermittently sent at a sub scanning linear speed A (printing operation). That is to say, when the end of the roll paper sheet 120 is detected as described above, it is possible to form images in the area extending from the image forming area of the recording head 11 to the end of the roll paper sheet 120, and therefore image forming can be continued.

Subsequently, it is determined whether printing has been completed.

When printing is not completed, it is determined whether the end of the roll paper sheet 120 has passed the position of the pre-conveying roller inlet sensor 151 and the pre-conveying roller inlet sensor 151 has been turned OFF.

At this time, when the pre-conveying roller inlet sensor 151 is not turned OFF, i.e., when the end of the roll paper sheet 120 has not passed the pre-conveying roller inlet sensor 151, the process of intermittently sending the roll paper sheet 120 at the sub scanning linear speed A and forming images is repeated.

Then, when the end of the roll paper sheet 120 passes the position of the pre-conveying roller inlet sensor 151, and the pre-conveying roller inlet sensor 151 is turned OFF, it is determined whether the remaining amount (remaining amount of paper sheet) from the recording area of the recording head 11 to the end of the roll paper sheet 120 is less than the image information amount to be printed (remaining amount of paper sheet<image information amount).

At this time, when the remaining amount of paper sheet is not less than the image information amount, i.e., when the remaining amount of the roll paper sheet 120 is greater than or equal to the image information amount to be printed, the roll paper sheet 120 is intermittently sent at a sub scanning linear speed A to form an image.

When the remaining amount of paper sheet is less than the image information amount, it is determined whether the conveying amount of the roll paper sheet 120 corresponding to one intermittent sending amount (one pass) is less than the image information amount to be printed.

When the conveying amount corresponding to one pass is not less than the image information amount to be printed, i.e., when the conveying amount corresponding to one pass is greater than or equal to the image information amount, the roll paper sheet 120 is intermittently sent at a sub scanning linear speed A to form an image.

When printing is completed, or when printing is not completed but the pre-conveying roller inlet sensor 151 is turned off, the remaining amount of paper sheet is less than the image information amount, and the conveying amount corresponding to one pass is less than the image information amount, the process proceeds to the process illustrated in FIG. 9.

Here, it is determined whether an instruction to dry the roll paper sheet 120 is given.

When an instruction to dry the roll paper sheet 120 is given, it is determined whether the drying time (stopping time, waiting time) of the roll paper sheet is less than or equal to a time T1.

When the drying time is less than or equal to a time T1, the carriage 5 is moved to the position of the idle jetting receiver 34 which is the left idle jetting receiver. Furthermore, when the drying time is not less than or equal to a time T1, the carriage 5 is moved to a home position (position on the side of the maintenance recovery mechanism 30), and the nozzle surfaces of the recording heads 11 are capped with the suction cap 41 and the moisturizing caps 42, and sub scanning is put on hold.

In either case, the driving of the suction fan 26 is stopped (OFF), the driving of the pair of conveying rollers 131 is stopped, and then the sending of the roll paper sheet 120 is stopped during the drying time to dry the sheet.

When the drying time has elapsed, the sheet sending operation is performed at a linear speed B (BOA), and it is determined whether the pre-conveying roller inlet sensor 151 has been turned OFF. Here, when the pre-conveying roller inlet sensor 151 is turned OFF, the sheet is sent by a predetermined amount, and the pair of conveying rollers 131 (sheet feeding rollers) are caused to pressurize/contact each other.

When an instruction to dry the roll paper sheet is not given, the carriage 5 is withdrawn from above the sheet, and a sheet discharge operation is performed. Here, the driving of the suction fan 26 is stopped, the roll paper sheet 120 is sent at the linear speed B, and it is determined whether the pre-conveying roller inlet sensor 151 has been turned OFF. When the pre-conveying roller inlet sensor 151 is turned off, the sheet is sent by a predetermined amount, and the pair of conveying rollers 131 (sheet feeding rollers) are caused to pressurize/contact each other.

As described above, even when the end of a non-adhering roll is detected, it is possible to continue printing up to the end of the roll paper sheet, and therefore the roll paper sheet can be fully used, so that wasteful consumption of the roll paper sheet is reduced.

Figure 10:
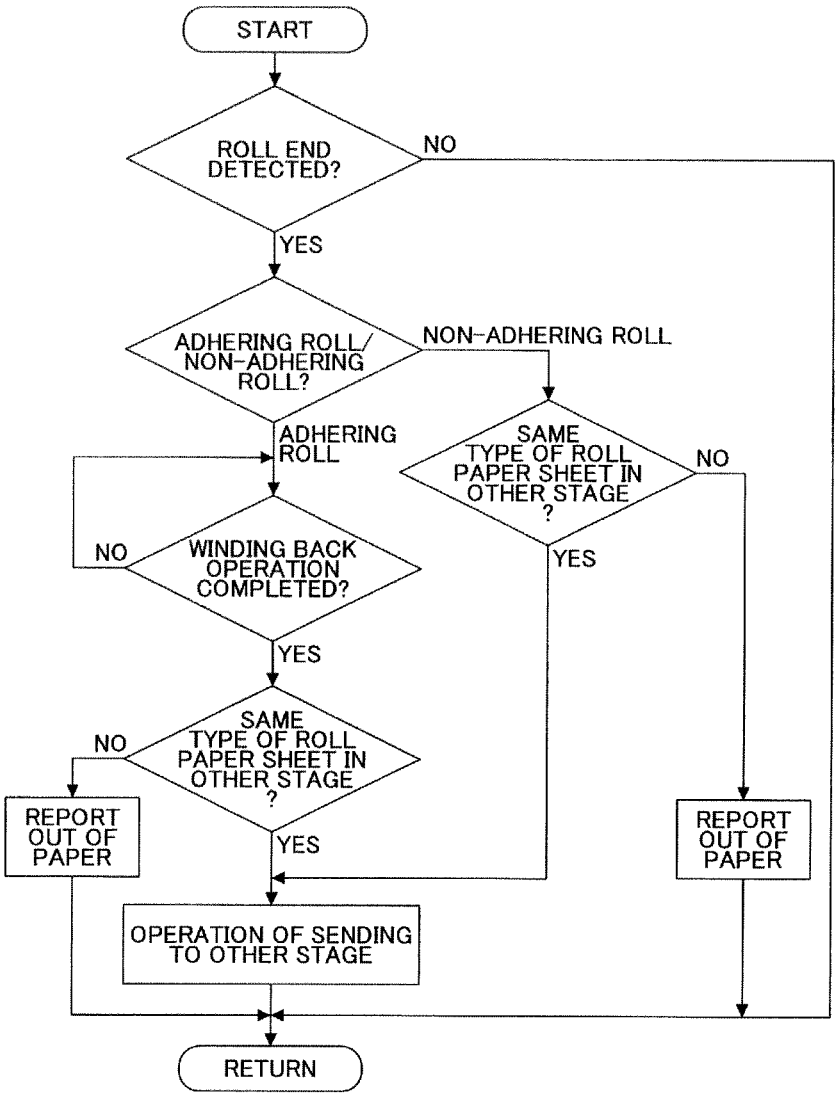
FIG. 10 is a flowchart of an operation after a roll end is detected when plural stages of roll paper sheets can be attached.

Next, a description is given of an operation after roll end is detected when plural stages of roll paper sheets can be attached, with reference to the flow chart of FIG. 10. This process is applicable to both an adhering roll and a non-adhering roll.

First, when roll end is detected, it is determined whether the roll for which roll end is detected is an adhering roll or a non-adhering roll.

When the roll is an adhering roll, a winding back operation is completed, and it is determined whether the roll paper sheet of another stage is the same type of roll paper sheet as that for which roll end has been detected.

When the roll paper sheet of the other stage of the same type, a sending operation is performed for the roll paper sheet of the other stage, and the print information (image information) remaining when roll end is detected is printed onto the roll paper sheet of the other stage. Furthermore, when the roll paper sheet of the other stage is not of the same type, out of paper is reported.

When the roll is a non-adhering roll, the winding back operation is not performed, and therefore, it is determined whether the roll paper sheet of another stage is the same type of roll paper sheet as that for which roll end has been detected.

When the roll paper sheet of another stage is of the same type, a sending operation is performed for the roll paper sheet of the other stage, and the print information (image information) remaining when roll end is detected is printed onto the roll paper sheet of the other stage. Furthermore, when the roll paper sheet of the other stage is not of the same type, out of paper is reported. When image forming is not continued after roll end is detected in the case of a non-adhering roll, the print information (image information) remaining when roll end is detected may be printed onto the roll paper sheet of the other stage.

Accordingly, a printing operation can be efficiently continued.

In the present application, a "sheet" is not limited to paper, but may be an OHP, a cloth, glass, and a substrate, on which ink droplets and other liquid can adhere to, and may be refereed toes recorded medium, a recording medium, a recording sheet, a recording-use sheet, etc. Furthermore, image forming, recording, printing, etc., are synonyms.

An image forming apparatus is an apparatus for forming images by jetting ink onto media such as paper, threads, fiber, cloth, leather, metal, plastic, glass, timber, and ceramics. Forming images does not only mean to form images having meaning such as characters and figures onto media, but also means forming images without any meaning such as patterns onto media (including liquid jetting devices that simply jet liquid droplets onto media).

In the present application, ink is not limited ink per se, but ink is a collective term of all kinds of liquid with which images can be formed, including recording liquid, fixing-processing liquid, and liquid. For example, liquid DNA samples, patterning materials, and resin are also included.

An image is not limited to a planar image; an image may be three-dimensionally formed on the sheet, or a three-dimensional object may be formed on the sheet.

The image forming apparatus may be, unless particularly specified, a serial type image forming apparatus and a line type image forming apparatus.

According to one embodiment of the present invention, an image forming apparatus is provided, in which when a roll type medium has its end fixed and the end is detected and the roll type medium is wound back, ink does not adhere to the conveying roller or the cutting means.

According to one embodiment of the present invention, an image forming apparatus is provided, in which even after the end of the roll type medium is detected, the image forming operation is continued, so that wasteful consumption of the roll type medium is reduced.

According to an aspect of the present invention, there is provided an image forming apparatus including a roll type medium including a long medium that is wound around a core member as a roll; a feeding unit configured to feed the roll type medium; an image forming unit configured to form an image on the roll type medium; a non-fixed roll end detecting unit configured to detect an end of the roll type medium whose end is not fixed to the core member; a medium detecting unit configured to detect the roll type medium, the medium detecting unit being located between the image forming unit and the feeding unit; and a control unit configured to cause the image forming unit to continue forming the image on the roll type medium until at least the medium detecting unit cannot detect the roll type medium, when the non-fixed roll end detecting unit detects the end of the roll type medium, wherein the image forming apparatus further includes a first determining unit configured to determine whether a remaining length of the roll type medium is greater than an image information amount to be printed when the non-fixed roll end detecting unit detects the end of the roll type medium and the medium detecting unit cannot detect the roll type medium, wherein when the remaining length of the roll type medium is greater than the image information amount to be printed, the image forming unit continues to form the image on the roll type medium.

According to an aspect of the present invention, the image forming apparatus further includes a second determining unit configured to determine whether one sending amount of the roll type medium is greater than an image information amount to be printed when the non-fixed roll end detecting unit detects the end of the roll type medium and the medium detecting unit cannot detect the roll type medium, wherein when the one sending amount of the roll type medium is greater than the image information amount to be printed, the image forming unit continues to form the image on the roll type medium.

According to an aspect of the present invention, the image forming apparatus further includes a cutting unit configured to cut the roll type medium, wherein when the image is continued to be formed after detecting the end of the roll type medium, the roll type medium is ejected without being cut by the cutting unit.

According to an aspect of the present invention, in the image forming apparatus, a plurality of the roll type media are attached, the non-fixed roll end detecting unit is further configured to detect a type of the roll type medium, and when the fixed roll end detecting unit detects that a type of a first roll type medium is the same as a type of a second roll type medium, the feeding unit feeds the second roll type medium.

According to an aspect of the present invention, the image forming apparatus further includes a fixed roll end detecting unit configured to detect an end of a roll type medium whose end is fixed to the core member; and a unit configured to form, on another roll type medium, an image corresponding to remaining image information when the fixed roll end detecting unit detects the end of the roll type medium whose end is fixed to the core member or when the non-fixed roll end detecting unit detects the and of the roll type medium whose end is not fixed to the core member and the image forming unit discontinues to form the image.

The image forming apparatus is not limited to the specific embodiments described herein, and variations and modifications may be made without departing from the scope of the present invention.

The present application is based on Japanese Priority Patent Application No. 2012-039446, filed on Feb. 25, 2012, and Japanese Priority Patent Application No. 2012-039448, filed on Feb. 25, 2012, the entire contents of which are hereby incorporated herein by reference.

What is claimed is:

1. An image forming apparatus comprising:

a roll type medium including a long medium that is wound around a core member as a roll;

a feeding unit configured to feed the roll type medium;

an image forming unit configured to form an image on the roll type medium;

a fixed roll end detecting unit configured to detect an end of the roll type medium whose end is fixed to the core member;

a determining unit configured to determine whether to stop, for a predetermined time period, the roll type medium on which the image has been formed by the image forming unit, when the fixed roll end detecting unit detects the end of the roll type medium; and a control unit configured to stop an operation of the feeding unit when the determining unit determines to stop the roll type medium for the predetermined time period, and to cause the feeding unit to perform an operation of winding back the roll type medium when the predetermined time period has elapsed.

2. The image forming apparatus according to claim 1, further comprising:

a cutting unit configured to perform a cutting operation of cutting the roll type medium, wherein the cutting unit cuts the roll type medium when the predetermined time period has elapsed, and the control unit causes the feeding unit to perform the operation of winding back the roll type medium after the roll type medium has been cut.

3. The image forming apparatus according to claim 2, further comprising:

a guide member configured to guide the roll type medium to a side facing the image forming unit; and a suction unit configured to suction the roll type medium to the guide member, wherein when the feeding unit performs the operation of winding back the roll type medium, the suction unit stops operating.

4. The image forming apparatus according to claim 3, wherein the suction unit stops suctioning the roll type medium until the predetermined time period elapses.

5. The image forming apparatus according to claim 3, wherein when the cutting unit is performing the cutting operation, the suction unit suctions the roll type medium.

6. The image forming apparatus according to claim 1, wherein a plurality of the roll type media are attached, the fixed roll end detecting unit is further configured to detect a type of the roll type medium, and when the fixed roll end detecting unit detects that a type of a first roll type medium is the same as a type of a second roll type medium, the feeding unit feeds the second roll type medium.

7. The image forming apparatus according to claim 1, further comprising:

a conveying unit including a conveying roller and a pressurizing roller that sandwich and convey the roll type medium, the conveying unit being located on an upstream side in a medium conveying direction of the image forming unit, and when the operation of winding back the roll type medium is performed, the roll type medium is wound back by being sandwiched by the conveying unit.

8. The image forming apparatus according to claim 7, further comprising:

a wind back unit configured to wind back the roll type medium to the core member at a higher speed than a conveying speed of the conveying unit, when the operation of winding back the roll type medium is performed.

9. An image forming apparatus comprising:

a roll type medium including a long medium that is wound around a core member as a roll;

a feeding unit configured to feed the roll type medium;

an image forming unit configured to form an image on the roll type medium;

a non-fixed roll end detecting unit configured to detect an end of the roll type medium whose end is not fixed to the core member;

a medium detecting unit configured to detect the roll type medium, the medium detecting unit being located between the image forming unit and the feeding unit; and a control unit configured to cause the image forming unit to continue forming the image on the roll type medium until at least the medium detecting unit cannot detect the roll type medium, when the non-fixed roll end detecting unit detects the end of the roll type medium.

* * * * *